US008997932B1

(12) United States Patent
Ochoa

(10) Patent No.: US 8,997,932 B1
(45) Date of Patent: Apr. 7, 2015

(54) CLIMBING SAFETY ASSEMBLY

(71) Applicant: Steven Ochoa, Las Vegas, NV (US)

(72) Inventor: Steven Ochoa, Las Vegas, NV (US)

( * ) Notice: Subject to any disclaimer, the term of this patent is extended or adjusted under 35 U.S.C. 154(b) by 0 days.

(21) Appl. No.: 14/160,722

(22) Filed: Jan. 22, 2014

(51) Int. Cl.
*E06C 1/36* (2006.01)
*E06C 7/48* (2006.01)

(52) U.S. Cl.
CPC ..... *E06C 7/48* (2013.01)

(58) Field of Classification Search
CPC ..... E06C 7/48
USPC ..... 182/206, 116
See application file for complete search history.

(56) References Cited

U.S. PATENT DOCUMENTS

| | | | | |
|---|---|---|---|---|
| 4,469,195 | A | 9/1984 | Sartain | |
| D348,938 | S | 7/1994 | Kennett | |
| 5,638,916 | A * | 6/1997 | Schneider | 182/206 |
| 7,575,097 | B2 | 8/2009 | Sheridan et al. | |
| 7,963,368 | B2 | 6/2011 | Scudera et al. | |
| 8,011,476 | B1 | 9/2011 | Alcon | |
| 2002/0108811 | A1 * | 8/2002 | Ulmschneider et al. | 182/206 |
| 2004/0216955 | A1 | 11/2004 | Unger | |
| 2010/0213009 | A1 | 8/2010 | Guinovart et al. | |
| 2012/0024630 | A1 * | 2/2012 | VanLaningham | 182/116 |

* cited by examiner

*Primary Examiner* — Alvin Chin-Shue

(57) ABSTRACT

A climbing safety assembly for securing a ladder to a stanchion includes a plate that may abut a stanchion so the plate extends laterally away from the stanchion. The plate selectively engages a ladder. The ladder is retained proximate the stanchion so the ladder may be safely climbed by a user. A hook is operationally coupled to the plate. The hook may selectively engage the stanchion so the hook retains the plate on the stanchion. A belt is operationally coupled to the plate. The belt may be extendable around the stanchion so the plate is retained on the stanchion.

14 Claims, 6 Drawing Sheets

CLIMBING SAFETY ASSEMBLY

BACKGROUND OF THE DISCLOSURE

Field of the Disclosure

The disclosure relates to climbing safety devices and more particularly pertains to a new climbing safety device for securing a ladder to a stanchion.

SUMMARY OF THE DISCLOSURE

An embodiment of the disclosure meets the needs presented above by generally comprising a plate that may abut a stanchion so the plate extends laterally away from the stanchion. The plate selectively engages a ladder. The ladder is retained proximate the stanchion so the ladder may be safely climbed by a user. A hook is operationally coupled to the plate. The hook may selectively engage the stanchion so the hook retains the plate on the stanchion. A belt is operationally coupled to the plate. The belt may be extendable around the stanchion so the plate is retained on the stanchion.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
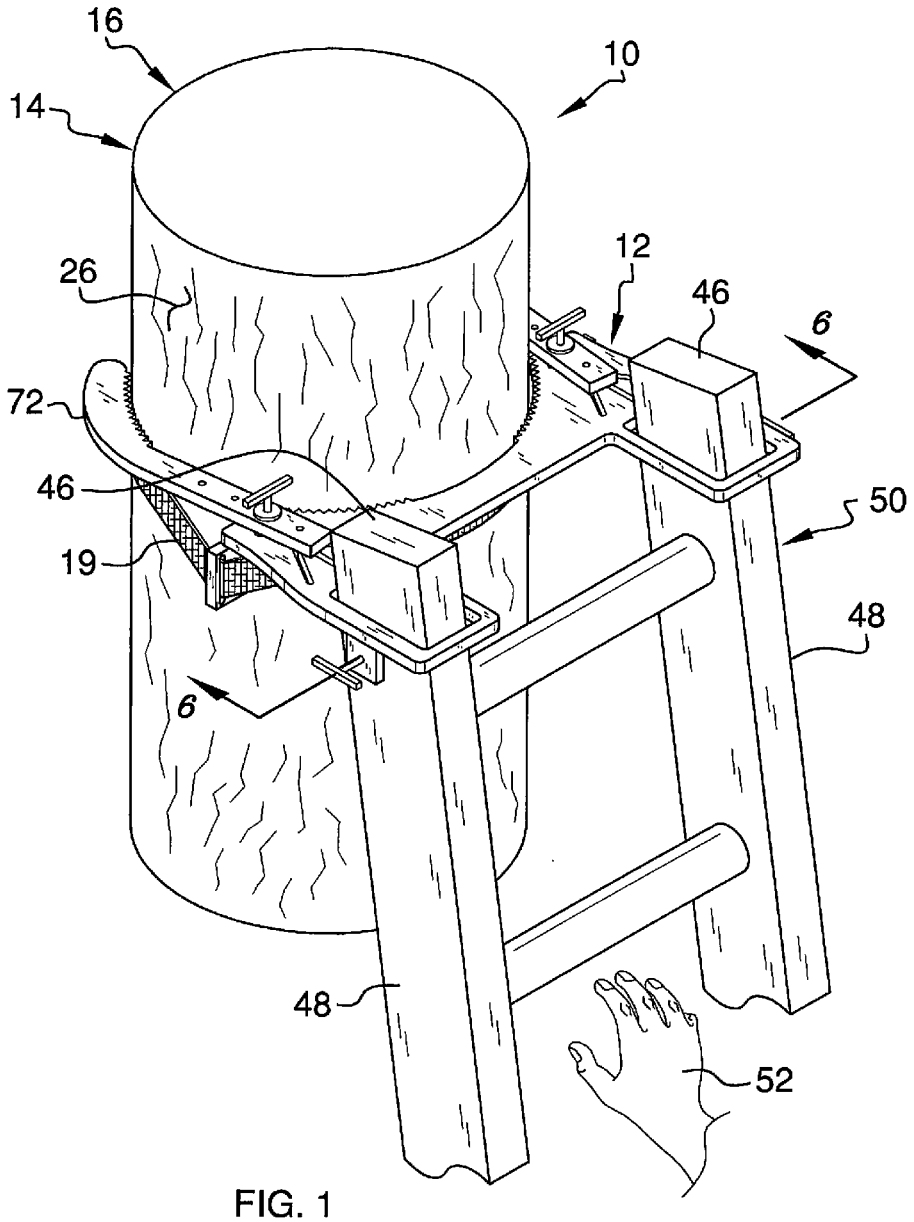
FIG. 1 is an in-use view of a climbing safety assembly according to an embodiment of the disclosure.
Figure 2:
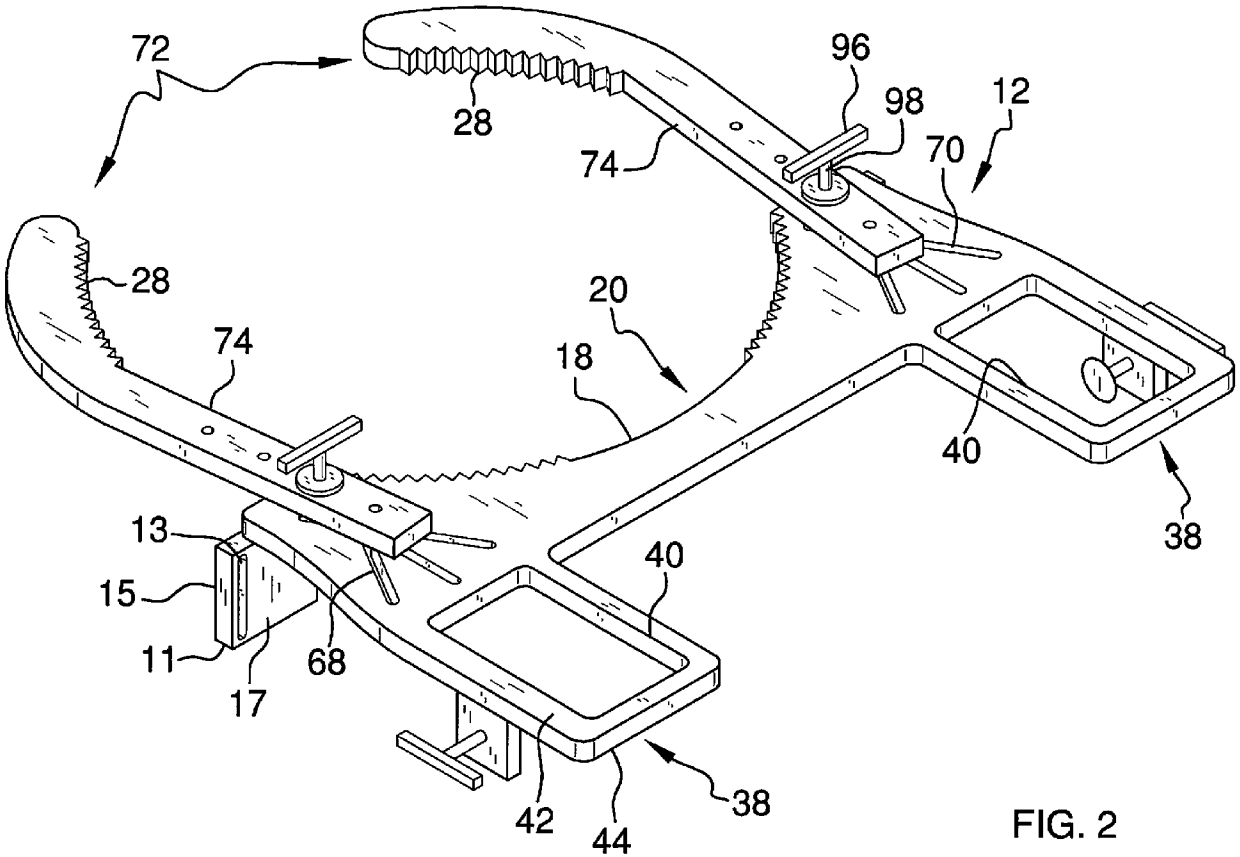
FIG. 2 is a top perspective view of an embodiment of the disclosure.
Figure 3:
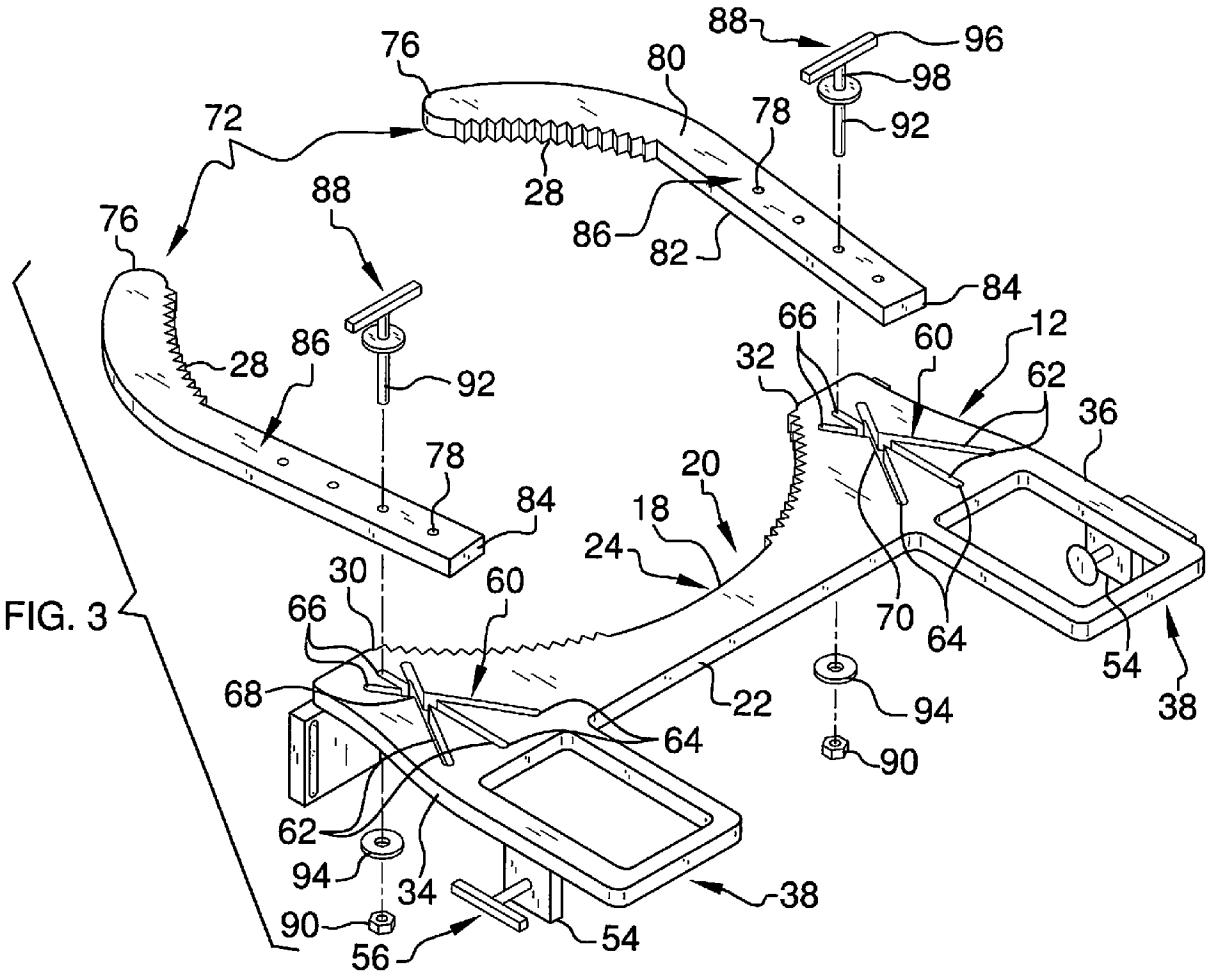
FIG. 3 is an exploded top perspective view of an embodiment of the disclosure.
Figure 4:
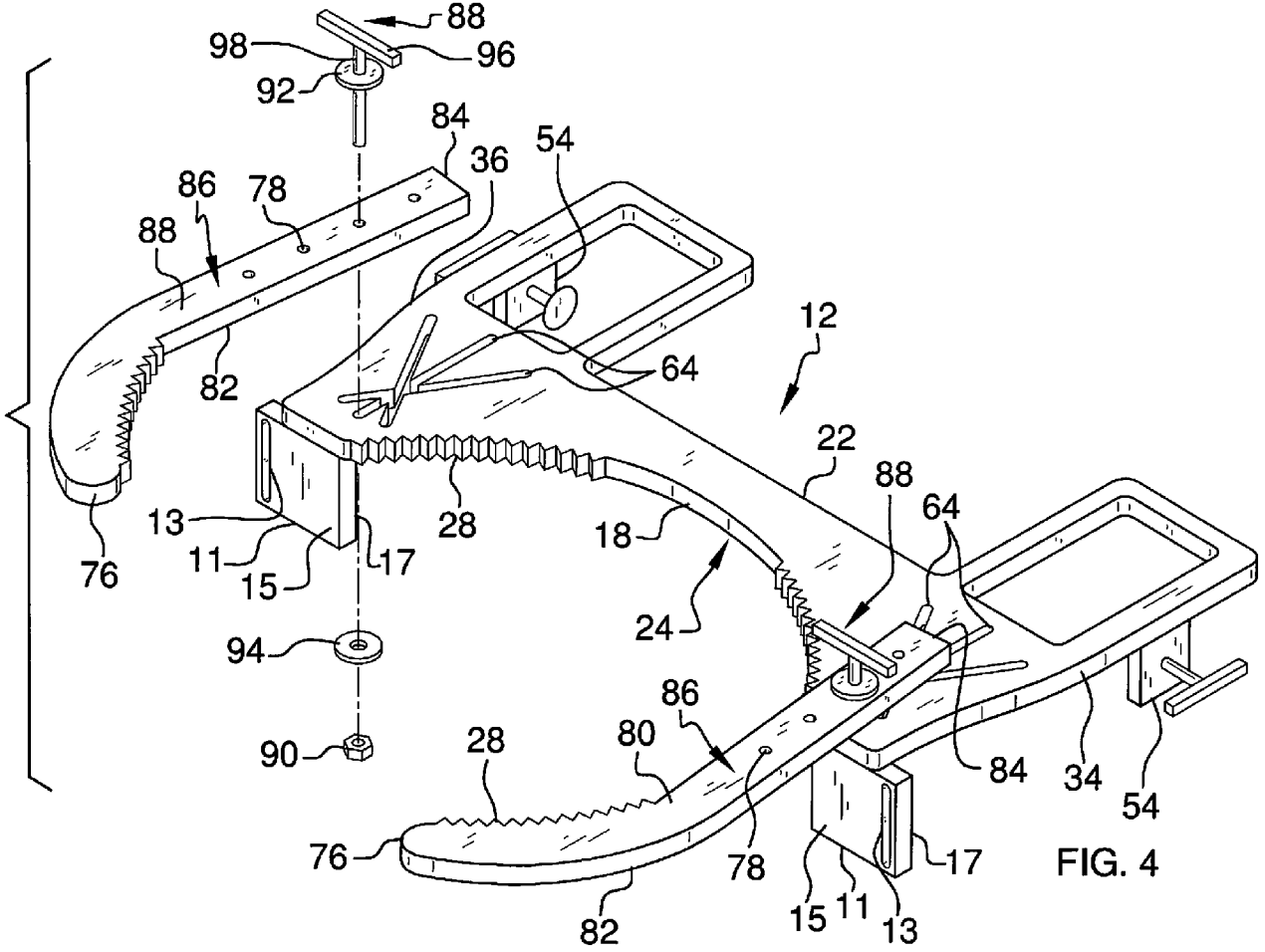
FIG. 4 is a front perspective view of an embodiment of the disclosure.
Figure 5:
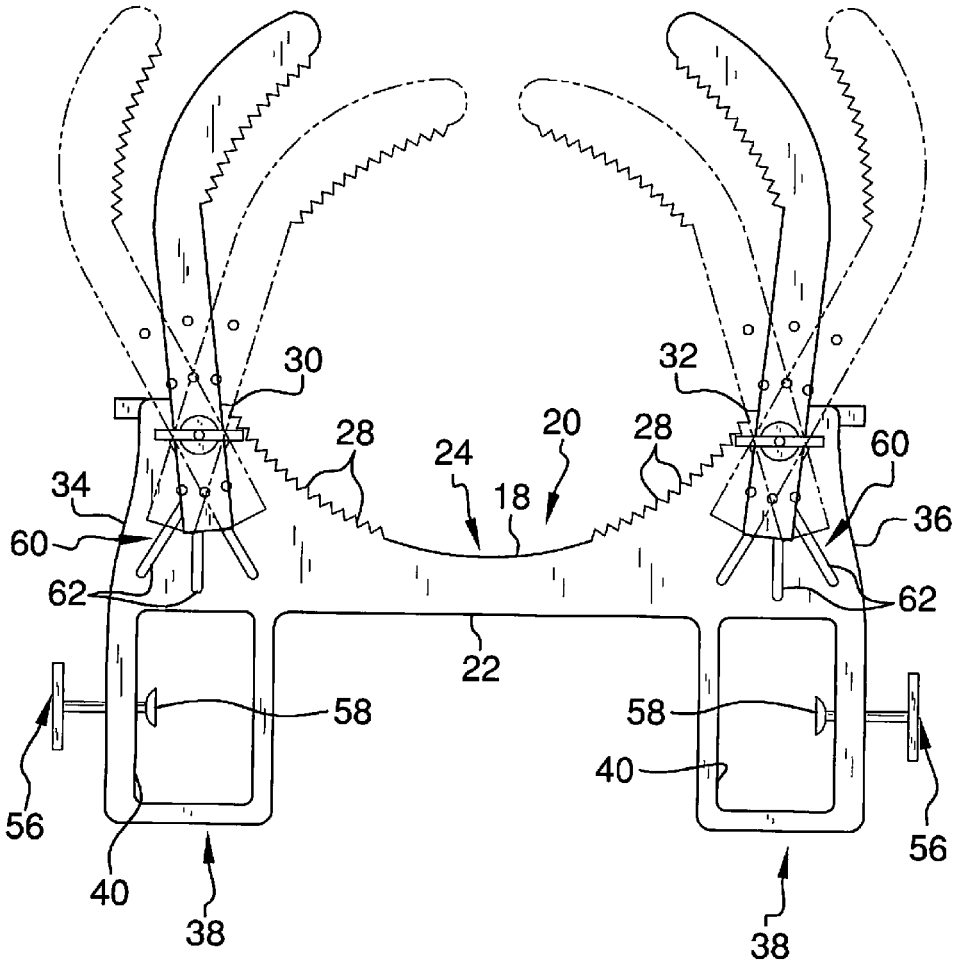
FIG. 5 is a top view of an embodiment of the disclosure.
Figure 6:
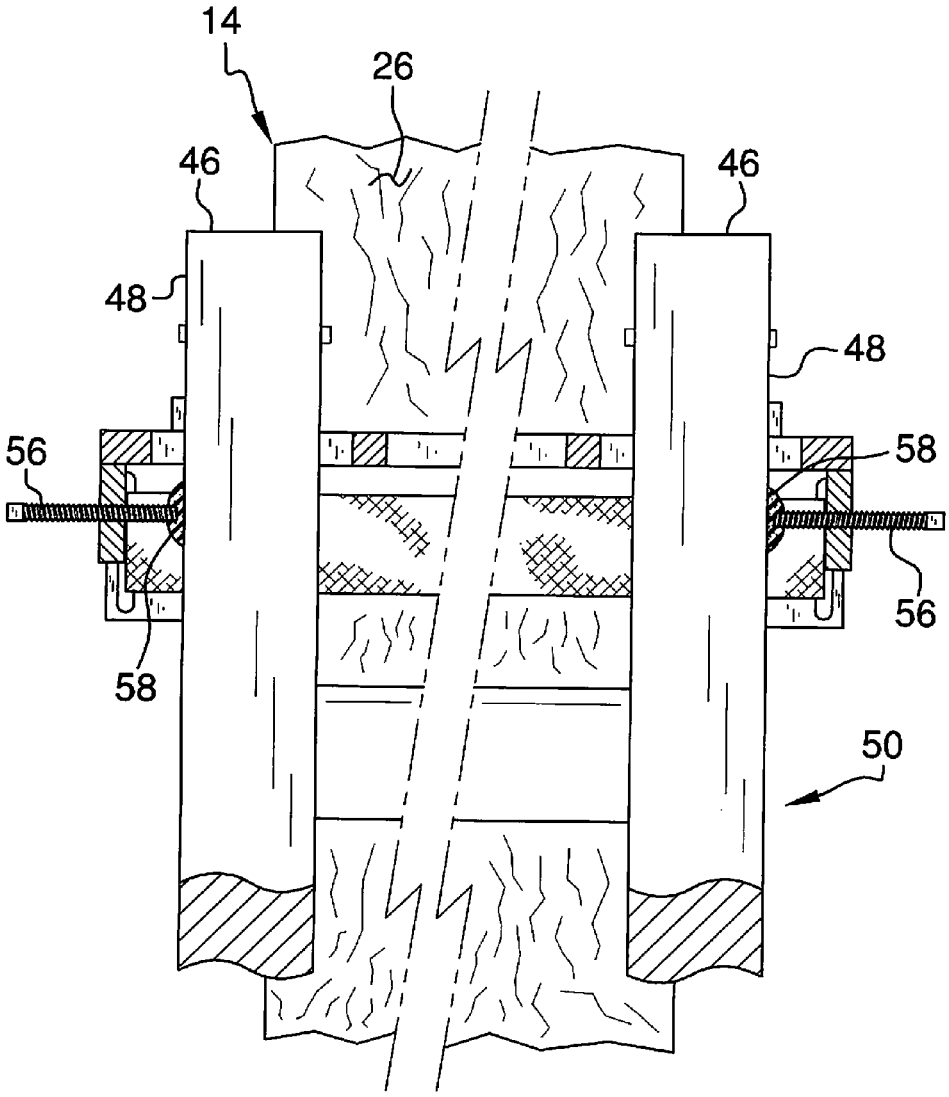
FIG. 6 is a back view of an embodiment of the disclosure.

With reference now to the drawings, and in particular to FIGS. 1 through 6 thereof, a new climbing safety device embodying the principles and concepts of an embodiment of the disclosure and generally designated by the reference numeral 10 will be described.

As best illustrated in FIGS. 1 through 6, the climbing safety assembly 10 generally comprises a plate 12 that may be positioned proximate a stanchion 14 so the plate 12 extends laterally away from the stanchion 14. The stanchion 14 may be a palm tree 16 or other species of tree. A leading edge 18 of the plate 12 defines a concavely acruate portion 20 of the plate 12 with respect to a rear edge 22 of the plate 12. Continuing, the concavely arcuate portion 20 of the plate 12 may have a width between 33 cm and 38 cm and a depth between 7 cm and 13 cm. A center 24 of the concavely arcuate portion 20 of the plate 12 may be spaced apart from the rear edge 22 of the plate 12 a distance between 2.5 cm and 5 cm. Lastly, the plate 12 is positioneable so the concavely arcuate portion 20 of the plate 12 coextensively abuts a curved outer surface 26 of the stanchion 14.

The leading edge 18 of the concavely arcuate portion 20 of the plate 12 comprises a plurality of teeth 28. Moreover, the plurality of teeth 28 engages the curved outer surface 26 of the stanchion 14. The concavely arcuate portion 20 of the plate 12 is centrally positioned. Each of a first end 30 and a second end 32 of the concavely arcuate portion 20 of the plate 12 is spaced apart from an associated one of a first lateral edge 34 and a second lateral edge 36 of the plate 12. The spacing distance between the concavely arcuate portion 20 of the plate 12 and each of the first 34 and second 36 lateral edges of the plate 12 may be between 5 cm and 7.5 cm. Lastly, the plate 12 may have an overall width between 40 cm and 50 cm.

A ladder portion 38 of the plate 12 extends rearwardly from the rear edge 22 of the plate 12. A ladder aperture 40 extends through a top side 42 and a bottom side 44 of the ladder portion 38 of the plate 12. Additionally, the ladder portion 38 of the plate 12 is one of a pair of ladder portions 38 of the plate 12 each positioned proximate an associated one of the first 34 and second 36 lateral edges of the plate 12. Each of the ladder apertures 40 on the pair of ladder portions 38 of the plate 12 insertably receives a top 46 of an associated one of a pair of ladder side rails 48.

Each of the ladder portions 38 of the plate 12 may have a length between 12 cm and 15 cm and a width between 10 cm and 13 cm. Moreover, each of the pair of ladder apertures 40 may have a length between 12 cm and 15 cm and a width between 5 cm and 10 cm. Each of the pair of ladder portions 38 of the plate 12 may be spaced apart a distance between 25 cm and 30 cm. Finally, the pair of ladder portions 38 of the plate 12 ensures a ladder 50 is retained proximate the stanchion 14 so the ladder 50 may be safely climbed by a user 52.

A pair of ladder retainers 54 is coupled to and extends downwardly from the bottom side 44 of the each of the pair of ladder portions 38 of the plate 12 proximate an associated one of the first 34 and second 36 lateral edges of the plate 12. Continuing, a pair of ladder fasteners 56 each extends through an associated one of the pair of ladder retainers 54 so a flared end 58 of the pair of ladder fastener 54 engages an associated one of the pair of ladder side rails 48. The flared end 58 of the pair of ladder fasteners 56 may be comprised of a resiliently compressible material such as rubber or other similar material. Lastly, the pair of ladder fasteners 56 retains the ladder 50 in the pair of ladder portions 38 of the plate 12.

An adjustment aperture 60 extends through the top side 42 and the bottom side 44 of the plate 12 proximate the leading edge 18 of the plate 12. The adjustment aperture 60 comprises a plurality of intersecting arms 62 so the adjustment aperture 60 has a star shape. Each of the intersecting arms 62 of the adjustment aperture 60 may have a length between 10 cm and 13 cm. Additionally, a back end 64 of each of the intersecting arms 62 of the adjustment aperture 60 may be spaced apart a distance between 1.5 cm and 2.5 cm. The plurality of intersecting arms 62 intersects at a point that is closer to a front end 66 of each of the plurality of intersecting arms 62 than the back end 64 of each of the plurality of intersecting arms 62.

The adjustment aperture 60 is one of a pair of adjustment apertures 60. A first one of the adjustment apertures 68 is positioned between the first end 30 of the concavely arcuate portion 20 of the plate 12 and the first lateral edge 34 of the plate 12. A second one of the adjustment apertures 70 is positioned between the second end 32 of the concavely arcuate portion 20 of the plate 12 and the second lateral edge 36 of the plate 12. Finally, each of the first 68 and second 70 adjustment apertures 60 extends between the leading edge 18 of the plate 12 and an associated one of the pair of ladder portions 38 of the plate 12.

A hook 72 is operationally coupled to the plate 12 so the hook 72 selectively engages the stanchion 14. The hook 72 retains the plate 12 on the stanchion 14. An inside edge 74 of the hook comprises a plurality of teeth 28 positioned proximate a curved second end 76 of the hook 72. Continuing, the curved second end 76 of the hook 72 defines an arc that may have a radius between 7.5 cm and 10 cm with respect to the inside edge 74 of the hook 72. The plurality of teeth 28 engages the curved outer surface 26 of the stanchion 14. Additionally, the hook 72 may have a length between 25 cm and 33 cm and a width between 2.5 cm and 5 cm.

A fastener aperture 78 extends through a top side 80 and a bottom side 82 of the hook 72. The fastener aperture 78 is one of a plurality of fastener apertures 78 that are evenly distributed between a first end 84 of the hook 72 and a center 86 of the hook 72. Moreover, the hook 72 is one of a pair of hooks 72 that are each positioned proximate an associated one of the pair of adjustment apertures 60. The pair of hooks 72 are oriented so the curved second ends 76 of each of the pair of hooks 72 are directed toward each other.

A fastener 88 extends through a selected one of the plurality of fastener apertures 78 and engages a selected one of the plurality of intersecting arms 62 of an associated one of the pair of adjustment apertures 60. The fastener 88 movably couples the hook 72 to the plate 12 such that the bottom side 82 of the hook 72 abuts the top side 42 of the plate 12. Moreover, the fastener 88 is one of a pair of the fasteners 88 each extending through an associated one of the pair of hooks 72. Each of the pair of fasteners 88 is positionable within a selected one of the plurality of intersecting arms 62 of the associated one of the pair of adjustment apertures 60 so the pair of hooks 72 are positioned closer together or further apart.

The pair of fasteners 88 is positionable at a selected point along the selected intersecting arm 62 so the curved second end 76 of each of the pair of hooks 72 is positioned a selected distance away from the leading edge 18 of the plate 12. Continuing, the pair of fasteners 88 is positionable at the selected point within the selected intersecting arm 62 to allow the pair of hooks 72 to accommodate a wide range of stanchion 14 diameters. The pair of fasteners 88 may comprise a nut 90, bolt 92 and washer 94 of any conventional design. A handle 96 may be coupled to a top 98 of the bolt 92 to be gripped by the user 52.

A belt retainer 11 is coupled to and extends downwardly from the bottom side 44 of the plate 12 proximate the leading edge 18 of the plate 12. Continuing, a belt aperture 13 extends through a front side 15 and a back side 17 of the belt retainer 11. The belt retainer 11 may have a width and a height between 5 cm and 7.5 cm. Moreover, the belt retainer 11 is one of a pair of belt retainers 11 each positioned proximate an associated one of the first 34 and second 36 lateral edges of the plate 12. A belt 19 is extendable through the belt aperture 13 in each of the pair of belt retainers 11 so the belt 19 is retained on the plate 12. The belt 19 may be extended around the stanchion 14 so the plate 12 is retained on the stanchion 14.

In use, the plate 12 is positioned at a selected point on the stanchion 14. The belt 19 is extended around the stanchion 14 and tightened so the plate 12 is retained at the selected point on the stanchion 14. Additionally, each of the fasteners 88 is positioned at the selected point in the selected plurality of intersecting arms 62 of the associated one of the pair of adjustment apertures 60 so the pair of hooks 72 each engages the stanchion 14. The ladder 50 is positioned so the top 46 of each of the side rails 48 of the ladder 50 is positioned within the associated one of the pair of ladder apertures 40. The user 52 then safely climbs the ladder 50 to perform maintenance or other similar activity on the stanchion 14. The assembly 10 prevents the ladder 50 from tipping or otherwise moving in a manner that places the user 52 in danger of falling away from the stanchion 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A climbing safety assembly for securing a ladder to a stanchion, said assembly comprising:

a plate configured to abut the stanchion wherein said plate extends laterally away from the stanchion, said plate selectively engaging a ladder wherein the ladder is retained proximate the stanchion wherein the ladder may be safely climbed by a user;

a hook operationally coupled to said plate wherein said hook is configured to selectively engage the stanchion wherein said hook retains said plate on the stanchion;

a belt operationally coupled to said plate wherein said belt is configured to be extendable around the stanchion wherein said plate is retained on the stanchion;

an adjustment aperture extending through a top side and a bottom side of said plate proximate a leading edge of said plate, said adjustment aperture comprising a plurality of intersecting arms wherein said adjustment aperture has a star shape.

2. The assembly according to claim 1, further comprising a leading edge of said plate defining a concavely acruate portion of said plate with respect to a rear edge of said plate wherein said concavely arcuate portion of said plate is configured to coextensively abut a curved outer surface of the stanchion.

3. The assembly according to claim 2, further comprising said concavely arcuate portion of said plate being centrally positioned wherein each of a first end and a second end of said concavely arcuate portion of said plate is spaced apart from an associated one of a first lateral edge and a second lateral edge of said plate.

4. The assembly according to claim 1, further comprising:

a ladder portion of said plate extending rearwardly from a rear edge of said plate;

a ladder aperture extending through a top side and a bottom side of said ladder portion of said plate;

said ladder portion of said plate being one of a pair of said ladder portions of said plate each positioned proximate an associated one of a first lateral edge and a second lateral edge of said plate; and each of said ladder apertures on said pair of ladder portions of said plate insertably receiving a top of an associated one of a pair of ladder side rails.

5. The assembly according to claim 1, further comprising said adjustment aperture being one of a pair of said adjustment apertures, a first one of said adjustment apertures being positioned between a first end of a concavely arcuate portion of said plate and a first lateral edge of said plate, a second one of said adjustment apertures being positioned between a second end of said concavely arcuate portion of said plate and a second lateral edge of said plate.

6. The assembly according to claim 1, further comprising a fastener aperture extending through a top side and a bottom side of said hook.

7. The assembly according to claim 6, further comprising said fastener aperture being one of a plurality of said fastener apertures being evenly distributed between a first end of said hook and a center of said hook.

8. The assembly according to claim 1, further comprising a fastener extending through a selected one of a plurality of fastener apertures and engaging a selected one of a plurality of intersecting arms of an adjustment aperture wherein said hook is movably coupled to said plate such that a bottom side of said hook abuts a top side of said plate.

9. The assembly according to claim 1, further comprising said hook being one of a pair of said hooks each being positioned proximate an associated one of a pair of adjustment apertures.

10. The assembly according to claim 1, further comprising a belt retainer coupled to and extending downwardly from a bottom side of said plate proximate a leading edge of said plate.

11. The assembly according to claim 10, further comprising a belt aperture extending through a front side and a back side of said belt retainer.

12. The assembly according to claim 11, further comprising said belt retainer being one of a pair of said belt retainers each positioned proximate an associated one of a first lateral edge and a second lateral edge of said plate.

13. The assembly according to claim 1, further comprising said belt being extendable through a belt aperture in each of a pair of belt retainers wherein said belt is retained on said plate.

14. A climbing safety assembly for securing a ladder to a stanchion, said assembly comprising:

a plate configured to be positioned proximate the stanchion wherein said plate extends laterally away from the stanchion, a leading edge of said plate defining a concavely acruate portion of said plate with respect to a rear edge of said plate wherein said concavely arcuate portion of said plate is configured to coextensively abut a curved outer surface of the stanchion, said concavely arcuate portion of said plate being centrally positioned wherein each of a first end and a second end of said concavely arcuate portion of said plate is spaced apart from an associated one of a first lateral edge and a second lateral edge of said plate;

a ladder portion of said plate extending rearwardly from said rear edge of said plate;

a ladder aperture extending through a top side and a bottom side of said ladder portion of said plate, said ladder portion of said plate being one of a pair of said ladder portions of said plate each positioned proximate an associated one of said first and second lateral edges of said plate, each of said ladder apertures on said pair of ladder portions of said plate insertably receiving a top of an associated one of a pair of ladder side rails wherein the ladder is retained proximate the stanchion wherein the ladder may be safely climbed by a user;

an adjustment aperture extending through said top side and said bottom side of said plate proximate said leading edge of said plate, said adjustment aperture comprising a plurality of intersecting arms wherein said adjustment aperture has a star shape, said adjustment aperture being one of a pair of said adjustment apertures, a first one of said adjustment apertures being positioned between said first end of said concavely arcuate portion of said plate and said first lateral edge of said plate, a second one of said adjustment apertures being positioned between said second end of said concavely arcuate portion of said plate and said second lateral edge of said plate;

a hook operationally coupled to said plate wherein said hook is configured to selectively engage the stanchion wherein said hook retains said plate on the stanchion;

a fastener aperture extending through a top side and a bottom side of said hook, said fastener aperture being one of a plurality of said fastener apertures being evenly distributed between a first end of said hook and a center of said hook, said hook being one of a pair of said hooks each being positioned proximate an associated one of said pair of adjustment apertures;

a fastener extending through a selected one of said plurality of fastener apertures and engaging a selected one of said plurality of intersecting arms of said adjustment aperture wherein said hook is movably coupled to said plate such that a bottom side of said hook abuts said top side of said plate, said fastener being one of a pair of said fasteners each extending through an associated one of said pair of hooks;

a belt retainer coupled to and extending downwardly from said bottom side of said plate proximate said leading edge of said plate;

a belt aperture extending through a front side and a back side of said belt retainer, said belt retainer being one of a pair of said belt retainers each positioned proximate an associated one of said first and second lateral edges of said plate; and a belt being extendable through said belt aperture in each of said pair of belt retainers wherein said belt is retained on said plate wherein said belt is configured to be extendable around the stanchion wherein said plate is retained on the stanchion.

* * * * *